US006623417B1

(12) United States Patent
Zettier

(10) Patent No.: US 6,623,417 B1
(45) Date of Patent: Sep. 23, 2003

(54) CENTRIFUGE HAVING A ROTATABLE SLEEVE AND A RESTRICTION POINT

(75) Inventor: Karl-Heinz Zettier, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 09/869,596

(22) PCT Filed: Jan. 4, 2000

(86) PCT No.: PCT/EP00/00008

§ 371 (c)(1),
(2), (4) Date: Sep. 28, 2001

(87) PCT Pub. No.: WO00/41813

PCT Pub. Date: Jul. 20, 2000

(30) Foreign Application Priority Data

Jan. 11, 1999 (DE) ..... 199 00 667

(51) Int. Cl.[7] ..... B04B 11/08
(52) U.S. Cl. ..... 494/57
(58) Field of Search ..... 494/2–4, 56, 57, 494/68–70

(56) References Cited

U.S. PATENT DOCUMENTS 2,344,888 A * 3/1944 Lindgren
4,406,652 A * 9/1983 Nielsen
5,171,205 A * 12/1992 Monkenbusch
5,405,307 A * 4/1995 Borgstrom et al.

FOREIGN PATENT DOCUMENTS

| | | | |
|---|---|---|---|
| DE | 722279 | * | 7/1942 |
| DE | 886514 | * | 9/1953 |
| DE | 3833063 | * | 10/1989 |
| EP | 640398 | * | 3/1995 |
| WO | 91/03319 | * | 3/1991 |

OTHER PUBLICATIONS

Hanno–R. Lehmann, Karl–Heinz Zettier, *Whey Processing Lines,* Technical–scientific documentation No. 6, Third revised edition 1988, Published by Westfalia Separator AG.

* cited by examiner

*Primary Examiner*—Charles E. Cooley
(74) *Attorney, Agent, or Firm*—Barnes & Thornburg

(57) ABSTRACT

The invention relates to a centrifuge comprising the following: a centrifugal drum, and at least one, preferably two, stripping disc(s) for conducting liquid out of the centrifugal drum. The at least one stripping disc comprises at least one conducting channel which opens into a conducting chamber, whereby at least one restriction point is preferably provided between the conducting channel and the conducting chamber allocated thereto. A rotatable flow restrictor is assigned to said restriction point and, according to the respective position of rotation thereof, opens a more or less large cross-section of the at least one restriction point.

7 Claims, 1 Drawing Sheet

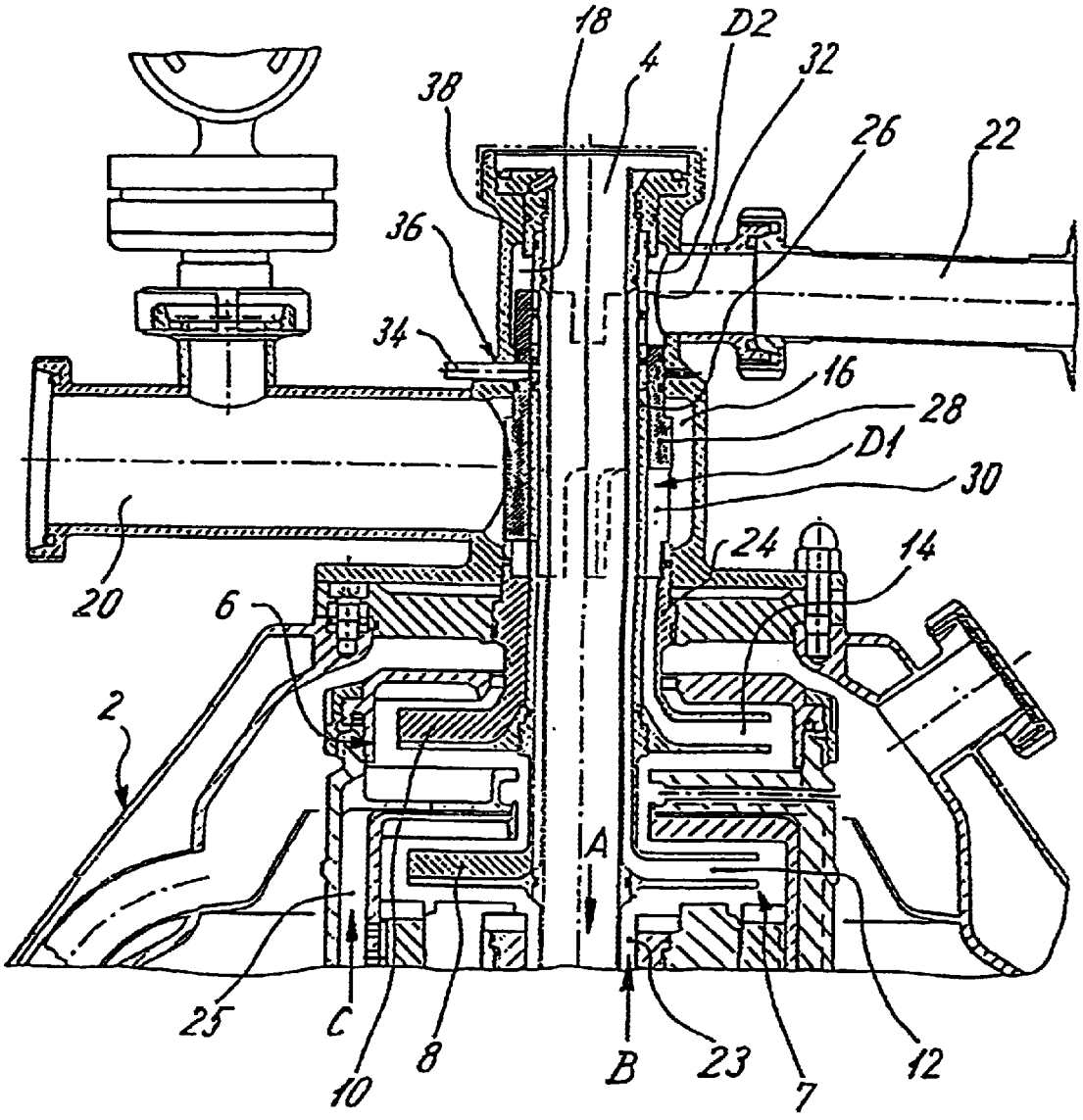
18
D2
4
32
38
26
22
36
34
16
28
D1
30
24
14
20
6
2
A
25
C
10
8
B
23
7
12

CENTRIFUGE HAVING A ROTATABLE SLEEVE AND A RESTRICTION POINT

BACKGROUND AND SUMMARY OF THE INVENTION

The invention relates to a centrifuge.

A centrifuge of this type is known from European Patent Document EP-A-0 640 398.

European Patent Document 886 514 C also shows a centrifuge whose first separating disk is pushed on an interior inlet tube and whose second separating disk is pushed over the first separating disk.

One centrifuge of this type is known from German Patent Document DE 38 33 063 C1. This document shows a centrifuge having a separating disk for draining liquids from a centrifugal drum The separating disk having two draining ducts which, starting from the periphery of the separating disk, first extend spirally inward and then perpendicularly upward and which each have a restriction point whose cross-section is variable by means of an axially adjustable restriction body.

The construction of the axially adjustable restriction body has been successful per se. However, if two separating disks are used instead of a single separating disk in order to drain two liquids of different densities, it is necessary to, in each case, assign separate restriction bodies to the two separating disks. If, during the operation, the centrifuge is acted upon by different amounts of liquids, it is also necessary to adjust the restriction bodies each separately, in the case of the two separating disks, in order to adapt them to the changed amount of liquid. Such a separate adjustment is difficult because the restrictions have to be adjusted with respect to one another such that they do not influence one another disadvantageously.

In view of these problems, it is an object of the invention to further develop the centrifuge of the above-mentioned type such that a constructively simple alternative, which can be handled in an uncomplicated manner, is created for the axial adjustment of the restriction points.

The invention achieves this goal.

As a result of the idea of the rotatable restriction body, an alternative possibility is created for adjusting the restriction cross-section which can be implemented in a constructively simple manner and which, because of the elimination of the axial adjustment of the restriction body, permits a particularly compact construction of the centrifuge while its handling is easy.

A sleeve is preferably fitted upon one of the rotary-cut disks and projects with its circumference into the outlet opening of the draining duct. As a result of the projection into the outlet opening, the sleeve is capable of partially closing the outlet opening and in this manner implementing the restriction effect. The construction as a cylindrical sleeve also permits a simple adjustment of the restriction cross-section by means of a handle which is mounted on the sleeve and can be gripped from the outside.

The changeability of the restriction effect can be implemented in an uncomplicated manner by providing the cylindrical sleeve with circumferential openings or (aperture-type) recesses —for example, in the axial end area—, which are distributed along the circumference such that, when the sleeve is rotated on the separating disk, they more or less cover the outlet opening of the at least one restriction point.

In addition to the above-mentioned advantages and according to another idea of the invention, the rotatability of the restriction body provides a simple possibility for solving the problems of coordinating the adjustment of the restriction cross-sections in the case of two separating disks. For this purpose, the circumferential openings or recesses of the sleeve are coordinated such that, when the sleeve is rotated on the separating disk, the cross-sections of the restriction points of several different separating disks, as a function of the flow of liquid into the centrifuge, are variable in a mutually coordinated manner. The mutual coordination of the recesses or openings in the sleeve is determined empirically. Theoretically, sleeves can thereby in each case be implemented for each application which have a suitable "aperture characteristic".

If the recesses in the circumference of the sleeve are constructed at both axial ends of the cylindrical sleeve so that, in each axial end area, one of the restriction points respectively is changed when the sleeve is rotated, the coordinated adjusting of two rotary-cut disks will be permitted.

Other objects, aspects and novel features of the present invention will become apparent from the following detailed description of the invention when considered in conjunction with the accompanying drawings.

BRIEF DESCRIPTION OF THE DRAWINGS

The FIGURE is a sectional view of a centrifuge according to the invention.

DETAILED DESCRIPTION OF THE PREFERRED EMBODIMENTS

The FIGURE illustrates a centrifuge which is constructed as a separator and which, in a manner known per se, has a centrifugal drum 2 (shown here only with respect to its starting point and fitted on in the downward direction) for separating a centrifugal material into various constituents. In the Figure, the centrifugal material or the centrifugal liquid is guided, for example, from above through a central inlet or an inlet tube 4 in the direction of the arrow A into the centrifugal drum.

The draining of two liquid constituents flowing out of the centrifugal drum 2 takes place in two separating chambers 6, 7 in each case by means of a separating disk 8, 10 which are pushed axially over one another. The separating disks 8, 10 each have at least one, preferably two draining ducts 12, 14 which each lead into a draining chamber 16, 18 from which the liquids are drained through outlet tubes 20, 22 respectively. The liquids of different densities are introduced into the separating chambers 6, 7 in the direction of the arrows B and C through ducts 23, 25 respectively. The ducts 23 and 25 are situated at different distances radially from the axis of rotation of the centrifugal drum and thus permit the draining of liquids of different densities.

The draining ducts 12, 14 of the separating disks extend first from the lower outer circumference of the separating disks 8, 10 inward and then extend axially upward inside the tube-type attachments 24, 226 of the separating disks 8, 10. In this case, the tube-type attachment 24 of the outer separating disk 10 is pushed over the tube-type attachment 26 of the inner separating disk 8, so that the outer draining duct 14 is formed between the inner and the outer separating disk 8, 10. The inner and lower separating disk 8 guides the liquid from the lower separating chamber 7 into the draining chamber 18 which is situated above the draining chamber 16 of the upper and outer separating disk 10. The tube-type attachment 26. of the inner separating disk 8 is pushed over the inlet tube 4 so that a section of the inner draining duct 12 is formed between the tube-type attachment 26 and the inlet tube 4.

A cylindrical sleeve 28 adjoins the upper axial end of the tube-type attachment 24 of the outer separating disk 10, and is also fitted onto the tube-type attachment 26 of the inner separating disk 8. The cylindrical sleeve 28 extends from the lower draining chamber 16 into the upper draining chamber 18 and is provided in its upper and lower axial end areas with openings or recesses 30, 32. When the sleeve 28 is rotated on the tube-type attachment 26, that rotation exposes a more or less larger cross-section of the mouths or outlet openings of the draining ducts 12, 14 into the draining chambers 16, 18 respectively in the manner of restrictions $D_1D_2$ depending on the rotating position of the sleeve 28 on the tube-type attachment 26. In this manner, while the amount of liquid is variable, the restriction points D1, D2 associated with the draining ducts 12, 14 of both separating disks 8, 10 can be adjusted jointly and as a function of one another by rotating only one structural element, specifically the sleeve 28.

The precise further development of the sleeve 28 and its recesses 30, 32 is determined in that the optimal ratio of the cross-section of the upper restriction to the cross-section of the lower restriction is determined empirically as a function of the amount of liquid for an application (for example, milk). As a function of such an examination, the recesses 30, 32 are then distributed on the circumference of the sleeve 28.

The rotating of the sleeve 28 is carried out by means of a handle 34 which is inserted into the circumferential shell of the sleeve. The handle 34 projects radially to the outside through a slot-type recess 36 in an outer tube section 38 and is adjusted depending on the flow of liquid into the centrifuge, for which a corresponding marking (not shown here), which corresponds to the amount of liquid, can be provided at the slot 36. Merely by rotating the handle 34, an optimal adjustment of the two restriction points to the respective in flowing amount of liquid can therefore be carried out.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A centrifuge comprising:

a) a centrifugal drum;

b) at least one separating disk for draining liquid from the centrifugal drum, the at least one separating disk having at least one draining duct which leads into a pertaining draining chambers;

c) a cylindrical sleeve having circumferential openings distributed along a circumference of the sleeve;

d) the circumferential openings being located between the at least one draining duct and the pertaining draining chamber, and defining at least one restriction point; and e) the sleeve being rotatable in the centrifuge such that, as a function of the sleeve's respective rotating position, the sleeve opens up a lesser or larger cross-section of the at least one restriction point at the circumferential openings.

2. The centrifuge according to claim 1, wherein the cylindrical sleeve is placed on one of the at least one separating disks and projects into an outlet opening of the at least one draining duct.

3. The centrifuge according to claim 1, wherein the circumferential openings of the sleeve are coordinated with one another such that, when the sleeve is rotated on the at least one separating disk, at least one respective cross-section of the at least one restriction point of several different separating disks can be varied in a mutually coordinated manner as a function of the flow of liquid into the centrifuge.

4. The centrifuge according to claim 1, wherein the openings are formed in an axial end area of the cylindrical sleeve.

5. The centrifuge according to claim 1, wherein the openings are provided at two axial ends of the cylindrical sleeve and, in each axial end area, a rotation of the sleeve changes one of the at least one restriction point.

6. The centrifuge according to claim 1, wherein a first separating disk of the at least one separating disk is pushed onto an inner inlet tube, and a second separating disk of the at least one separating disk is pushed over the first separating disk and, one draining duct of the at least one draining duct of the first separating disk located at an upper axial end of the cylindrical sleeve and one draining duct of the at least one draining duct of the second separating disk located at a lower axial end of the cylindrical sleeve lead into each of the at least one draining duct's pertaining draining chamber.

7. The centrifuge according to claim 1, wherein the sleeve is provided with a radially outward-projecting manual operating handle.

* * * * *